US009776035B2

(12) United States Patent
Nouri

(10) Patent No.: US 9,776,035 B2
(45) Date of Patent: Oct. 3, 2017

(54) PORTABLE HAMSTRING STRETCHER/EXERCISER DEVICE

(71) Applicant: Masoud Nouri, Glendale, CA (US)

(72) Inventor: Masoud Nouri, Glendale, CA (US)

( * ) Notice: Subject to any disclaimer, the term of this patent is extended or adjusted under 35 U.S.C. 154(b) by 39 days.

(21) Appl. No.: 15/136,263

(22) Filed: Apr. 22, 2016

(65) Prior Publication Data

US 2016/0236031 A1 Aug. 18, 2016

Related U.S. Application Data

(60) Provisional application No. 62/201,598, filed on Aug. 6, 2015.

(51) Int. Cl.

| | |
|---|---|
| ***A63B 23/04*** | (2006.01) |
| ***A63B 21/00*** | (2006.01) |
| *A63B 23/00* | (2006.01) |
| *A63B 23/08* | (2006.01) |
| *A63B 23/10* | (2006.01) |
| *A63B 23/035* | (2006.01) |

(52) U.S. Cl.

CPC ..... *A63B 21/151* (2013.01); *A63B 21/00185* (2013.01); *A63B 21/4034* (2015.10); *A63B 23/03541* (2013.01); *A63B 23/0482* (2013.01); *A63B 23/0488* (2013.01); *A63B 21/00069* (2013.01); *A63B 21/4011* (2015.10); *A63B 21/4013* (2015.10); *A63B 21/4035* (2015.10); *A63B 21/4043* (2015.10); *A63B 21/4047* (2015.10); *A63B 23/03508* (2013.01); *A63B 23/085* (2013.01); *A63B 23/10* (2013.01); *A63B 2023/006* (2013.01); *A63B 2208/0238* (2013.01); *A63B 2210/50* (2013.01)

(58) Field of Classification Search

CPC ..... A63B 21/151; A63B 21/4034; A63B 21/00185; A63B 23/03541; A63B 23/0482; A63B 23/0488; A63B 21/4011; A63B 21/4013; A63B 21/4035; A63B 21/4043; A63B 21/4047; A63B 21/00069; A63B 23/03508; A63B 23/085; A63B 23/10; A63B 2023/006; A63B 2208/0238; A63B 2210/50; A63B 23/0205; A63B 21/4037; A63B 2208/0242

USPC ..... 482/142

See application file for complete search history.

(56) References Cited

U.S. PATENT DOCUMENTS

| | | | | |
|---|---|---|---|---|
| 4,986,261 | A * | 1/1991 | Iams | A61H 1/0218 482/51 |
| 5,120,052 | A * | 6/1992 | Evans | A63B 23/0211 482/140 |
| 5,122,106 | A * | 6/1992 | Atwood | A61H 1/0244 482/131 |

(Continued)

*Primary Examiner* — Andrew S Lo

(74) *Attorney, Agent, or Firm* — Barry Choobin; Patent 360

(57) ABSTRACT

The embodiments herein provide a portable hamstring stretcher for stretching hamstring muscles and inner thigh muscles. The portable hamstring stretcher comprises a primary board, a secondary board (leg pieces), a plurality of hinges, a chain, a plurality of ratchet straps, a ratchet, a plurality of hinges, and a plurality of adjustable straps. A user lies down on the primary board and wraps his legs using the adjustable straps on the secondary board to exercise the hamstring muscles.

18 Claims, 14 Drawing Sheets

(56) References Cited

U.S. PATENT DOCUMENTS

| | | | | |
|---|---|---|---|---|
| 5,498,222 | A * | 3/1996 | Hur | A63B 21/055 482/112 |
| 7,014,602 | B2 * | 3/2006 | Yamauchi | A61H 1/0218 482/142 |
| 7,604,583 | B2 * | 10/2009 | Denisco | A61H 1/0244 482/142 |
| 8,795,014 | B2 * | 8/2014 | McCarthy | A63B 23/03541 441/129 |
| 9,566,470 | B2 * | 2/2017 | Malizia | A61H 1/024 |
| 2011/0009248 | A1 * | 1/2011 | Bronston | A63B 21/02 482/124 |
| 2012/0329619 | A1 * | 12/2012 | Goldberg | A63B 21/04 482/129 |
| 2014/0194266 | A1 * | 7/2014 | Raiten | A63B 23/0482 482/142 |
| 2015/0038300 | A1 * | 2/2015 | Forhan | A63B 21/00047 482/72 |

* cited by examiner

PORTABLE HAMSTRING STRETCHER/EXERCISER DEVICE

BACKGROUND

Technical Field

The embodiments herein are generally related to an exercise device. The embodiments herein are particularly related to the exercise device used for stretching the hamstring. The embodiments herein are more particularly related to a portable exercise device used for stretching hamstring.

Description of the Related Art

A hamstring is a muscle structure comprising of three main muscles biceps femoris, semitendinosus and semimembranosus, which extends from sit-bones to knees. The hamstring muscles are responsible for bending knees. A person is able to jump high, run fast and accelerate with explosive power when the hamstring muscles are strong. With well-developed hamstrings, a good health and good postures are maintained. A good hamstring muscle also helps in preventing the leg injuries.

Several varieties of hamstring stretchers are available in the market currently. The conventional hamstring stretchers are either bulky and have many parts thereby making it difficult to carry. The other conventional hamstring stretchers are operated electrically. The electrically operated hamstring stretchers have few constraints during usage at outdoors. Further, electricity is always required for operating such hamstring stretchers.

Hence, there is a need for a hamstring stretcher that is portable. Further, there is a need for a portable stretcher that does not require any electricity or electrical parts to operate. Still further, there is a need for a hamstring stretcher that is easy to use and allows the user to stretch the hamstring muscles for a longer duration without causing any injury.

The above-mentioned shortcomings, disadvantages and problems are addressed herein and which will be understood by reading and studying the following specification.

OBJECTS OF THE EMBODIMENTS HEREIN

The primary object of the embodiments herein is to provide a portable hamstring stretcher without use of electrical parts.

Another object of the embodiment herein is to provide a portable hamstring stretcher that is light and easy to assemble.

Yet another object of the embodiments herein is to provide a portable hamstring stretcher that is used by professionals and hobbyists.

Yet another object of the embodiments herein is to provide a portable hamstring stretcher that exercises the hamstring without straining other muscles of the body.

Yet another object of the embodiments herein is to provide a portable hamstring stretcher that is constructed economically.

Yet another object of the embodiments herein is to provide a portable hamstring stretcher that allows the user to stretch the hamstring muscles for a longer duration without causing any injury.

Yet another object of the embodiments herein is to provide a portable hamstring stretcher that allows the user to stretch inner thigh muscles.

Yet another object of the embodiments herein is to provide a portable hamstring stretcher for stretching the calf muscles and Achilles tendons.

Yet another object of the embodiments herein is to provide a portable hamstring stretcher/exerciser device which does not require any electrical application, thereby making the device safe and free from electrical hazards.

Yet another object of the embodiments herein is to provide a portable hamstring stretcher/exerciser device not requiring a strict maintenance and many parts.

Yet another object of the embodiments herein is to provide a portable hamstring stretcher/exerciser device which finds usage in gym, hospitals, physical therapies, home and the like.

Yet another object of the embodiments herein is to provide a portable hamstring stretcher/exerciser device which is folded and fit easily under a bed.

Yet another object of the embodiments herein is to provide a portable hamstring stretcher/exerciser device which is a light weight device, and allows the user to engage in multiple operations/functions without any complication.

Yet another object of the embodiments herein is to provide a portable hamstring stretcher/exerciser device to facilitate and prolong a stretching of the hamstring muscles by eliminating the need to exert a force by hand.

Yet another object of the embodiments herein is to provide a portable hamstring stretcher/exerciser device provided to gradually stretch the hamstring muscle, the inner thigh muscles and the Achilles tendons are without applying any other muscle of the body.

Yet another object of the embodiments herein is to provide a portable hamstring stretcher/exerciser device to stretch the muscles without any effort by the user, and to allow the stretching for long periods without any side effects or harmful effects.

Yet another object of the embodiments herein is to provide a portable hamstring stretcher/exerciser device to allow the user to engage in activities such as reading, watching television, texting, and the like as the portable hamstring device does not involve active participation of hands.

These and other objects and advantages of the embodiments herein will become readily apparent from the following detailed description taken in conjunction with the accompanying drawings.

SUMMARY

According to an embodiment herein, a portable hamstring stretcher/exerciser device is provided for stretching hamstring muscles, inner thigh muscles, calf muscles and Achilles tendon. The portable hamstring stretcher/exerciser device comprises an upper board configured for allowing a user to rest an upper part of the body and a lower board configured for allowing the user to rest the legs. The lower board comprises two boards for supporting leg pieces. The two boards include a lower left board for supporting a left leg of the user and a lower right board for supporting a right leg piece of the user. The left lower board and the right lower board are configured to move vertically and horizontally. A foot rest is mounted on the lower board through a plurality of hinges. The foot rest is mounted on both the left lower board and the right lower board. A plurality of hinges is provided for coupling the upper board with the left lower board and right lower board. The left lower board and the right lower board are configured to fold over the upper board. At least a chain is attached to both the left lower board and the right lower board. The chain is attached to side edges of both the left lower board and the right lower board or to the foot rest mounted on the left lower board and the right lower board.

According to an embodiment herein, a plurality of ratchets is attached to the upper board for linking with the chain of the left lower board and the chain of the right lower board. The plurality of ratchets is mounted next to a hand position of the user. According to an embodiment herein, the ratchet set is composed of two parts, a fixed end and an adjustable end. The fixed end remains constant and the adjustable end shortens by applying the ratchet. The fixed end has a snappable hook, and the adjustable end has "S" shaped hook that grabs the chain. According to an embodiment of the present invention, the snappable hook can be removed and attached to the rings on two locations of the upper board.

According to an embodiment herein, a plurality of ratchet straps is attached respectively to the plurality of ratchets attached to the upper board for holding the left lower board and the right lower board at any desired angle.

According to an embodiment herein, a plurality of hooks is attached respectively to the plurality of ratchet straps for coupling with the chain at any desired point on the chain.

According to an embodiment herein, a plurality of adjustable leg straps is attached to the lower boards for providing grip to the legs of user. The plurality of adjustable leg straps is attached to the left lower board. The plurality of adjustable leg straps is attached to the right lower board.

According to an embodiment herein, a plurality of bolt assemblies is mounted on the upper board, the left lower board and the right lower board and the foot piece respectively for attaching the ratchet straps and chains.

According to an embodiment herein, the ratchet is configured to pull the chain. The chain is pulled to move the lower leg vertically to shorten the length and pull hamstring muscle, the right leg of the user. Further, the chain is pulled to shorten the length and pull hamstring muscle, the left leg of the user. The chain is pulled to move the right lower board horizontally to stretch an inner thigh muscle of the right leg. According to an embodiment herein, the chain is pulled to move the left lower board horizontally to stretch an inner thigh muscle of the left leg. The chain is pulled to move the foot rest mounted on the left lower board to stretch a calf muscle or Achilles tendon on the left leg. The chain is pulled to move the foot rest mounted on the right lower board to stretch a calf muscle or Achilles tendon on the right leg of the user. The ratchet is attached to the plurality of ratchet straps and the chain. The ratchet is situated next to the user's hand.

According to an embodiment herein, the foot rest is removably mounted on both the left lower board and right lower board. The foot rest is removably mounted on the left lower board or the right lower board.

According to an embodiment herein, the left lower board and the right lower board are moved vertically and horizontally by selectively folding the left lower board and/or the right lower board over the upper board vertically or horizontally by adjusting the plurality of hinges.

According to an embodiment herein, the portable hamstring stretcher/exerciser device further comprises a plurality of holes provided respectively on the upper board, the left lower board, the right lower board, and the foot rest for receiving the plurality of bolt assemblies for securing the plurality of ratchet straps and the plurality of chains. The plurality of holes comprises a first set of holes, a second set of holes, and a third set of holes. The first set of holes are provided on the upper board for receiving a first bolt assembly for securing the plurality of ratchets to the upper board. The second set of holes are provided on the left lower board and the right lower board for receiving a second bolt assembly for security the chain respectively with the left lower board and the right lower board. The third set holes are provided on the foot rest mounted on the left lower board and/or the right lower board for receiving a third bolt assembly for securing the chain to the foot rest mounted on the left lower board and/or the right lower board. According to an embodiment herein, the portable hamstring stretcher/exerciser includes a fourth set of holes which are present at ideally 12 inches from the bottom of the upper board on both sides.

According to an embodiment herein, each bolt assembly comprises a screw, a plurality of washers, D-ring and a bolt.

According to an embodiment herein, the upper board is attached to the left lower board and the right lower board through a plurality of removable rotary coupling pins.

According to an embodiment herein, the foot rest is configured or designed to comply with a profile of a sole of the foot.

According to an embodiment herein, the plurality of snappable hooks are arranged in "S" shape.

According to an embodiment herein, the adjustable leg straps are configured to prevent a bending of knees of the user.

According to an embodiment herein, the upper board is covered using a soft material.

According to an embodiment herein, the upper board is integrally formed with the soft material. The soft material is selected from a group consisting of a gym mat, cotton cloth, rubber sheet, metal sheet, and plastic sheet. According to an embodiment herein, the upper board and the lower board is formed from a hard material. The examples of the hard material include, but are not limited to plywood, sheet metal, plastic board.

According to an embodiment herein, the lower board is covered using a soft material.

According to an embodiment herein, the lower board is integrally formed with the soft material. The soft material is selected from a group consisting of a gym mat, cotton cloth, rubber sheet, metal sheet, and plastic sheet.

According to an embodiment herein, the foot rest is removably mounted at any desired position on the left lower board or the right lower board by inserting an adjustable pin through a respective hole in a plurality of holes arranged at the side edges of the right lower board and left lower board.

According to an embodiment herein, the foot rest is formed with two pieces. The two pieces are an upper piece and a lower piece. The upper piece and lower pieces are coupled through a hinge to fold the upper piece over the lower piece to follow a sole of the user foot. The upper piece of the foot rest is folded over the lower piece to support the toe portion of the user foot.

According to an embodiment herein, the portable hamstring stretcher/exerciser device further comprises a slide stopper board mounted on the left lower board and right lower board to hold a left leg and a right leg in position during inner thigh stretching operation.

According to an embodiment herein, the ratchet strap is mounted to the upper edge or near bottom edge of the upper board.

The embodiments herein provide a portable hamstring stretcher for stretching hamstring muscles and inner thigh muscles. The portable hamstring stretcher comprises a primary board, a secondary board (leg pieces), a plurality of hinges, a chain, a plurality of ratchet straps, a ratchet, and a plurality of adjustable straps.

According to an embodiment herein, the primary board is configured to allow a user to rest upper part of the body and the primary board is covered using a soft material such as a gym mat.

According to an embodiment herein, the secondary board is configured to allow the user to rest the legs. The secondary board includes two leg pieces. Further, the secondary board is covered using a soft material such as gym mat. The two leg pieces of the secondary board are folded over by a plurality of hinges.

According to an embodiment herein, the plurality of hinges are configured for facilitating the folding of the two leg pieces over. The plurality of hinges are used for facilitating the stretching of the hamstring muscles and the inner thigh muscles both vertically and horizontally.

According to an embodiment herein, the chain is configured for connecting the two leg pieces with a ratchet strap. According to an embodiment herein, the chain is attached in the side of the two leg pieces.

According to an embodiment herein, the plurality of ratchet straps are configured for connecting the chain and the primary board through a ratchet. The ratchet straps provide flexibility for operating the portable hamstring device.

According to an embodiment herein, the ratchet is configured for pulling the chain. The chain is pulled to move the lower leg vertically to shorten the length and pull hamstring muscle, the right leg of the user. Further, the chain is pulled to shorten the length and pull hamstring muscle, the left leg of the user. The ratchet is attached to the plurality of ratchet straps and the chain. The ratchet is situated next to the user's hand. According to an embodiment herein, the chain is pulled to move the left lower board horizontally to stretch an inner thigh muscle of the left leg. According to an embodiment herein, the chain is pulled to move the right lower board horizontally to stretch an inner thigh muscle, of the right leg.

According to an embodiment herein, a plurality of hooks are configured for connecting the chain and the ratchet strap. The hooks are attached to the ratchet strap to provide a link between the primary board and the secondary board.

According to an embodiment herein, the plurality of adjustable leg straps are configured for providing a grip to the legs of user. The plurality of adjustable leg straps are freely operated and are placed under the two leg pieces and fold over the user legs.

According to an embodiment herein, a vertical movement and a horizontal movement of the hamstring muscles and the inner thigh muscles are facilitated by adjusting the plurality of hinges according to the requirement.

According to an embodiment herein, the primary board and the secondary boards further comprises a plurality of holes at the ends to facilitate a connection between the primary board and the secondary board through the ratchet and the chain.

According to an embodiment herein, the ratchet straps are connected to the primary board through a plurality of screws, D-rings, a washer and a bolt.

According to an embodiment herein, the ratchet has an option to pull the chain enough to a limit that is tolerable by the user by operating the ratchet.

According to an embodiment herein, the primary board is attached to the leg pieces of the secondary boards using a plurality of removable pins that allow the leg pieces of secondary boards to fold with respect to each other.

According to an embodiment herein, the portable hamstring stretcher further includes a foot-piece that allows the user to bend a foot while exercising/stretching the hamstring muscles. The foot-piece are folded at bottom and at a hinge above mid-point. According to an embodiment herein, the foot-piece follows a profile of the sole of the foot.

According to an embodiment herein, the plurality of hooks are designed/configured in "S" shape.

According to an embodiment herein, the adjustable leg straps are used for preventing a bending of the knees of the user.

According to an embodiment herein, an option is provided to add a measuring device. The measuring device displays the angle of folding and rotation. The measuring device further monitors a progress of the user as the portable hamstring stretcher is used regularly.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
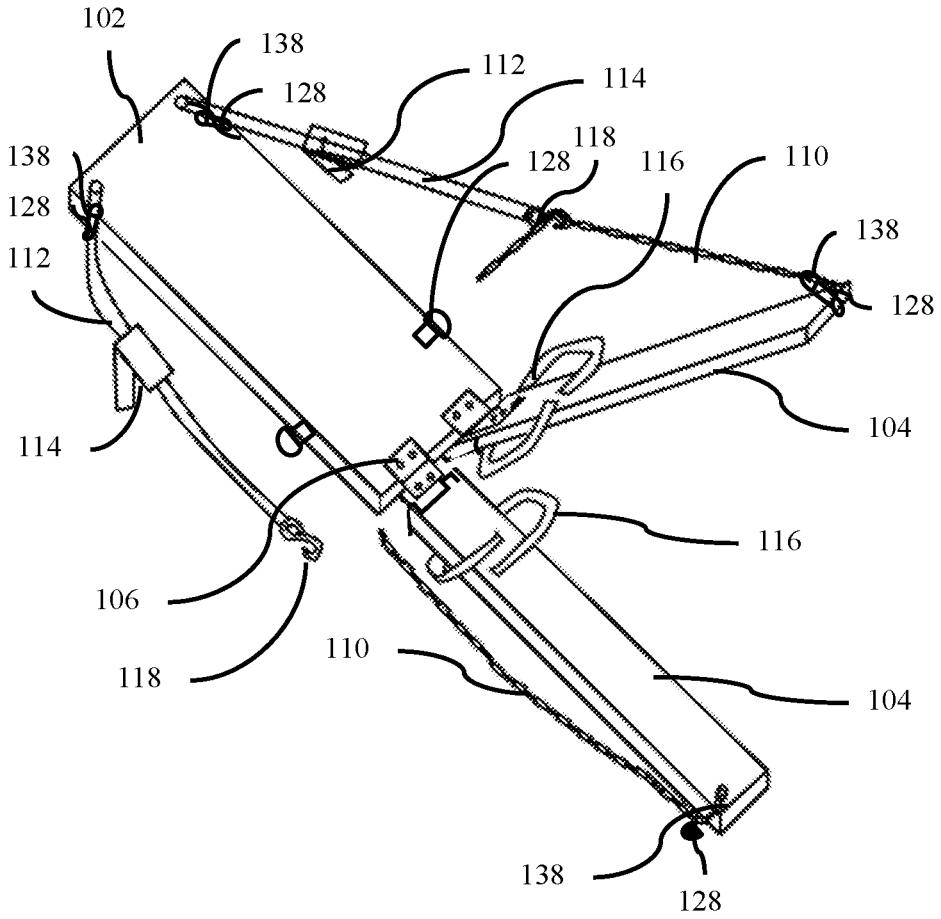
FIG. 1 illustrates a top side perspective view of a portable hamstring stretcher/exerciser device with lower board operated vertically, according to an embodiment herein.

Although the specific features of the embodiments herein are shown in some drawings and not in others. This is done for convenience only as each feature may be combined with any or all of the other features in accordance with the embodiments herein.

DETAILED DESCRIPTION OF THE INVENTION

In the following detailed description, reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

According to an embodiment herein, a portable hamstring stretcher/exerciser device is provided for stretching hamstring muscles, inner thigh muscles, calf muscles and Achilles tendon. The portable hamstring stretcher/exerciser device comprises an upper board configured for allowing a user to rest an upper part of the body and a lower board configured for allowing the user to rest the legs. The lower board comprises two boards for supporting leg pieces. The two boards include a lower left board for supporting a left leg of the user and a lower right board for supporting a right leg piece of the user. The left lower board and the right lower board are configured to move vertically and horizontally. A foot rest is mounted on the lower board through a plurality of hinges. The foot rest is mounted on both the left lower board and the right lower board. A plurality of hinges is provided for coupling the upper board with the left lower board and right lower board. The left lower board and the right lower board are configured to fold over the upper board. At least a chain is attached to both the left lower board and the right lower board. The chain is attached to side edges of both the left lower board and the right lower board or to the foot rest mounted on the left lower board and the right lower board.

According to an embodiment herein, a plurality of ratchets is attached to the upper board for linking with the chain of the left lower board and the chain of the right lower board. The plurality of ratchets is mounted next to a hand position of the user.

According to an embodiment herein, a plurality of ratchet straps is attached respectively to the plurality of ratchets attached to the upper board for holding the left lower board and the right lower board at any desired angle.

According to an embodiment herein, a plurality of hooks is attached respectively to the plurality of ratchet straps for coupling with the chain at any desired point on the chain.

According to an embodiment herein, a plurality of adjustable leg straps is attached to the lower boards for providing grip to the legs of user. The plurality of adjustable leg straps is attached to the left lower board. The plurality of adjustable leg straps is attached to the right lower board. The chain is pulled to move the lower leg vertically to shorten the length and pull hamstring muscle, the right leg of the user. Further, the chain is pulled to move the lower leg vertically to shorten the length and pull hamstring muscle, the left of the user. The chain is pulled to move the right lower board horizontally to stretch an inner thigh muscle of the right leg. According to an embodiment herein, the chain is pulled to move the left lower board horizontally to stretch an inner thigh muscle of the left leg. The chain is pulled to move the foot rest mounted on the left lower board to stretch a calf muscle or Achilles tendon on the left leg. The chain is pulled to move the foot rest mounted on the right lower board to stretch a calf muscle or Achilles tendon on the right leg of the user. The ratchet is attached to the plurality of ratchet straps and the chain. The ratchet is situated next or near to the user's hand.

According to an embodiment herein, a plurality of bolt assemblies is mounted on the upper board, the left lower board and the right lower board respectively for attaching the ratchet straps and chains.

According to an embodiment herein, the ratchet is configured to pull the chain. The chain is pulled to move the right lower board to horizontally stretch an inner thigh muscle of the right leg. According to an embodiment herein, the chain is pulled to move the left lower board horizontally to stretch an inner thigh muscle of the left leg, and the user alternates by applying ratchet tension for each leg. The chain is pulled to move the foot rest mounted on the left lower board to stretch a calf muscle or Achilles tendon on the left leg. The chain is pulled to move the foot rest mounted on the right lower board to stretch a calf muscle or Achilles tendon on the right leg of the user.

According to an embodiment herein, the foot rest is removably mounted on both the left lower board and right lower board. The foot rest is removably mounted on the left lower board or the right lower board.

According to an embodiment herein, the left lower board and the right lower board are moved vertically and horizontally by selectively folding the left lower board and/or the right lower board over the upper board vertically or horizontally by adjusting the plurality of hinges.

According to an embodiment herein, the portable hamstring stretcher/exerciser device further comprises a plurality of holes provided respectively on the upper board, the left lower board, the right lower board, and the foot rest for receiving the plurality of bolt assemblies for securing the plurality of ratchet straps and the plurality of chains. The plurality of holes comprises a first set of holes, a second set of holes, and a third set of holes. The first set of holes are provided on the upper board for receiving a first bolt assembly for securing the plurality of ratchets to the upper board. The second set of holes are provided on the left lower board and the right lower board for receiving a second bolt assembly for security the chain respectively with the left lower board and the right lower board. The third set holes are provided on the foot rest mounted on the left lower board and/or the right lower board for receiving a third bolt assembly for securing the chain to the foot rest mounted on the left lower board and/or the right lower board. According to an embodiment herein, the portable hamstring stretcher/ exerciser includes a fourth set of holes which are present at ideally 12 inches from the bottom of the upper board on both sides.

According to an embodiment herein, each bolt assembly comprises a screw, a plurality of washers, D-ring, and a bolt.

According to an embodiment herein, the upper board is attached to the left lower board and the right lower board through a plurality of removable rotary coupling pins.

According to an embodiment herein, the foot rest is configured or designed to comply with a profile of a sole of the foot.

According to an embodiment herein, the plurality of hooks are arranged in "S" shape.

According to an embodiment herein, the adjustable leg straps are configured to prevent a bending of knees of the user.

According to an embodiment herein, the upper board is covered using a soft material. According to an embodiment herein, the upper board and the lower board is formed from a hard material. The examples of the hard material include, but are not limited to plywood, sheet metal, plastic board.

According to an embodiment herein, the upper board is integrally formed with the soft material. The soft material is selected from a group consisting of a gym mat, cotton cloth, rubber sheet, metal sheet, and plastic sheet.

According to an embodiment herein, the lower board is covered using a soft material. According to an embodiment herein, the upper board and the lower board is formed from a hard material. The examples of the hard material include, but are not limited to plywood, sheet metal, plastic board.

According to an embodiment herein, the lower board is integrally formed with the soft material. The soft material is selected from a group consisting of a gym mat, cotton cloth, rubber sheet, metal sheet, and plastic sheet.

According to an embodiment herein, the foot rest is removably mounted at any desired position on the left lower board or the right lower board by inserting an adjustable pin through a respective hole in a plurality of holes arranged at the side edges of the right lower board and left lower board.

According to an embodiment herein, the foot rest is formed with two pieces. The two pieces are an upper piece and a lower piece. The upper piece and lower pieces are coupled through a hinge to fold the upper piece over the lower piece to follow a sole of the user foot. The upper piece of the foot rest is folded over the lower piece to support the toe portion of the user foot.

According to an embodiment herein, the portable hamstring stretcher/exerciser device further comprises a slide stopper board mounted on the left lower board and right lower board to hold a left leg and a right leg in position during hamstring stretching operation or inner thigh stretching operation.

According to an embodiment herein, the ratchet strap is mounted to the upper edge or bottom edge of the upper board.

The embodiments herein provide a portable hamstring stretcher for stretching hamstring muscles and inner thigh muscles. The portable hamstring stretcher comprises a primary board, a secondary board (leg pieces), a plurality of hinges, a chain, a plurality of ratchet straps, a ratchet, a plurality of hinges, and a plurality of adjustable straps.

According to an embodiment herein, the primary board is configured to allow a user to rest upper part of the body and the primary board is covered using a soft material such as a gym mat.

According to an embodiment herein, the secondary board is configured to allow the user to rest the legs. The secondary board includes two leg pieces. Further, the secondary board is covered using a soft material such as gym mat. The two leg pieces of the secondary board are folded over by a plurality of hinges.

According to an embodiment herein, the plurality of hinges are configured for facilitating the folding of the two leg pieces over. The plurality of hinges are used for facilitating the stretching of the hamstring muscles and the inner thigh muscles both vertically and horizontally.

According to an embodiment herein, the chain is configured for connecting the two leg pieces with a ratchet strap to the upper piece. According to an embodiment herein, the chain is attached in the side of the two leg pieces. The chain is pulled to move the lower leg vertically to shorten the length and pull hamstring muscle, the right leg of the user. Further, the chain is pulled to shorten the length and pull hamstring muscle, the left leg of the user. The chain is pulled to move the right lower board horizontally to stretch an inner thigh muscle of the right leg. According to an embodiment herein, the chain is pulled to move the left lower board horizontally to stretch an inner thigh muscle of the left leg. The chain is pulled to move the foot rest mounted on the left lower board to stretch a calf muscle or Achilles tendon on the left leg. The chain is pulled to move the foot rest mounted on the right lower board to stretch a calf muscle or Achilles tendon on the right leg of the user.

According to an embodiment herein, the plurality of ratchet straps are configured for connecting the chain and the primary board through a ratchet. The ratchet straps provide flexibility for operating the portable hamstring device.

According to an embodiment herein, the ratchet is configured for pulling the chain, and the chain is pulled using the ratchet to shorten a length between the pieces and pulls the hamstring muscle. The ratchet is attached to the plurality of ratchet straps and the chain. The ratchet is situated next or near to the user's hand.

According to an embodiment herein, a plurality of hooks are configured for connecting the chain and the ratchet strap. The hooks are attached to the ratchet strap to provide a link between the primary board and the secondary board.

According to an embodiment herein, the plurality of adjustable leg straps are configured for providing a grip to the legs of user. The plurality of adjustable leg straps are freely operated and placed under the two leg pieces and fold over the user legs.

According to an embodiment herein, a vertical movement and a horizontal movement of the hamstring muscles and the inner thigh muscles are facilitated by adjusting the plurality of hinges according to the requirement.

According to an embodiment herein, the primary board and the secondary boards further comprises a plurality of holes at the ends to facilitate a connection between the primary board and the secondary board through the ratchet and the chain.

According to an embodiment herein, the ratchet straps are connected to the primary board through a plurality of screws, a washer, D-rings, a plurality of snappable hooks, and a bolt.

According to an embodiment herein, the ratchet has an option to pull the chain enough to a limit that is tolerable by the user by operating the ratchet.

According to an embodiment herein, the primary board is attached to the leg pieces of the secondary boards using a plurality of removable pins that allow the leg pieces of secondary boards to fold with respect to each other.

According to an embodiment herein, the portable hamstring stretcher further includes a foot-piece that allows the user to bend a foot while exercising/stretching the hamstring muscles. The foot-piece are folded at bottom and at a hinge above the mid-point. According to an embodiment herein, the foot-piece follows a profile of the sole of the foot.

According to an embodiment herein, the plurality of hooks are designed/configured in "S" shape and/or snappable.

According to an embodiment herein, the adjustable leg straps are used for preventing a bending of the knees of the user.

FIG. 1 illustrates a top side perspective view of a portable hamstring stretcher/exerciser device with lower board operated vertically, according to an embodiment herein. With respect to FIG. 1, the portable hamstring stretcher/exerciser device includes a primary board (body piece) and mat 102, a secondary board (leg pieces) and mat 104, a plurality of hinges 106, a plurality of bolt assembly 108 comprising a plurality of screws, washers 132, D-rings 128 and bolt 126, a chain 110, a pair of ratchet straps 112, a pair of ratchet 114, an adjustable strap 116, and a "S" hook 118 and a plurality of snappable hooks 138.

The portable hamstring stretcher mainly functions on the ratchet 114 and the ratchet strap 112 pulling on a chain 110 attached to the secondary board (leg piece) using the adjustable strap 116 of the portable hamstring stretcher, to prevent the bending of the knees.

According to an embodiment herein, a user of the portable hamstring stretcher device lies down on the primary board 102 and straps the legs to the secondary boards (leg pieces) 104. Further, the user of the portable hamstring stretcher pulls the chain 110 to lift the lower board, to a maximum stretchable limit and fasten the hook 118 in the last possible point reachable on the chain 110. Once the chain 110 and the ratchet strap 112 are connected, the ratchet 114 is used to pull the chain 110 slowly to shorten the length to stretch the hamstring muscle. The ratchet 114 has an option to pull the chain enough to a limit that is tolerable by the user operating the ratchet 114, which is situated next to the user's hand.

According to an embodiment herein, the primary board 102 is attached to the pair of secondary boards (leg pieces) 104 with the hinges 106 using a plurality of removable pins that allows the secondary boards 104 to fold on each other to facilitate vertical movement of the secondary board 104 over the primary board 102, a ¼ inch outside edge clearances and a ¼ inch gap is created.

According to an embodiment herein, the chain 110 is attached to the top of the secondary board (leg pieces) 104 on the side with the snappable hook 138 to a "D" ring. Further, the two ratchet straps 112 are attached to a "D" ring on the primary board 102.

According to an embodiment herein, the portable hamstring stretcher/exerciser device is operated both horizontally and vertically. For operating the portable hamstring horizontally, the hinges 106 are connected through screws, to the secondary board (leg pieces) 104 using a plurality of removal pins or a plurality of leather material. Further, the foot piece 120 is installed/mounted on the secondary board (leg pieces) 104 with a plurality of pin inserts to a plurality of holes provided on the side of the secondary board (leg pieces) 104 that are drilled periodically. The foot piece/footrest/foot board is folded at a bottom of the leg piece 102 and placed depending on the length of the user's leg, to follow a profile of the sole of the foot. According to an embodiment herein, the foot piece is customizable according to the needs of the user. For example, the foot-piece is configured/designed in the shape of the foot. In another example, the foot-piece is made of a bendable hard material.

According to an embodiment herein, the primary board 102 (body piece) is a board constructed from a light material. The examples of the materials used for constructing the primary board 102 includes, but are not limited to soft wood, plywood, hard wood, aluminum, and the like. The primary board 102 is covered with a material to provide a comfort to the user. The examples of the material used for coving the primary board 102 includes, but are not limited to soft mat, gym mat, leather, synthetic cover, and the like. According to an embodiment herein, the primary board 102 is large and wide enough to support the upper part of the user. According to an embodiment herein, the primary board 102 has a plurality of standard dimensions. For example, the dimension of the primary board is 2 feet×4 feet×0.75 inches.

The secondary boards (leg pieces) 104 are separated for each of the leg. According to an embodiment herein, the secondary board 104 is folded over a plurality of hinges 106 attached to the primary board 102. The plurality of hinges 106 are used for folding the secondary board (leg pieces) 104 over the mat attached to the primary board 102.

According to an embodiment herein, the plurality of screws, washers 132 and D-rings 128 and bolts 126 are secured with the ratchet straps and hooks through the ratchet 114. Further, the ratchet strap 112 is attached to the ratchet 114 with the "S" hook 118 on one end and the snapable hooks 138 on the other end. The ratchet 114 is attached to the ratchet strap 112, to shorten the length of the ratchet strap, once the user starts using the portable hamstring stretcher. According to an embodiment herein, the adjustable belt strap 116 is provided with an option to the leg of secondary board (leg pieces) 104 to prevent the bending of the knee of the user.

According to an embodiment herein, the secondary board (leg pieces) 104 are constructed from a lightweight materials. The examples of the materials used for constructing the secondary board (leg pieces) 104 include, but are not limited to wood such as plywood, plastic, light aluminum, and the like. The secondary board (leg pieces) 104 is available in a plurality of standard sizes. The example of the size of the secondary board (leg pieces) 104 include but are not limited to 10½ inches×4 feet×¾ inches, and the like. The secondary boards (leg pieces) 104 have a soft layer spread on it, to provide a comfort to the leg of the user. The example of the material spread on the secondary board (leg pieces) 104 include, but are not limited to gym mat, leather, cotton, and the like. According to an embodiment herein, the chain 110 that is used for connecting the hook 118 and the secondary board (leg pieces) 104 is a lightweight and a flexible material such as aluminum or plastic, or any other metal.

Further, the ratchet straps 112 are attached to the hooks at both ends to pull the hooks on straps closer to each other. According to an embodiment herein, the hooks 118 are "S" shaped hooks, and the hooks 138 are snappable. The plurality of hinges 106 are used for folding the secondary board (leg pieces) 104 in both horizontal and vertical directions. The adjustable strap 116 are the belts used to wrap around the secondary board (leg pieces) 104 to prevent the bending of the knees. According to an embodiment herein, the ratchet straps 112 are wide enough to support the chain and maintain a balance of the user using the portable hamstring stretcher.

Figure 2:
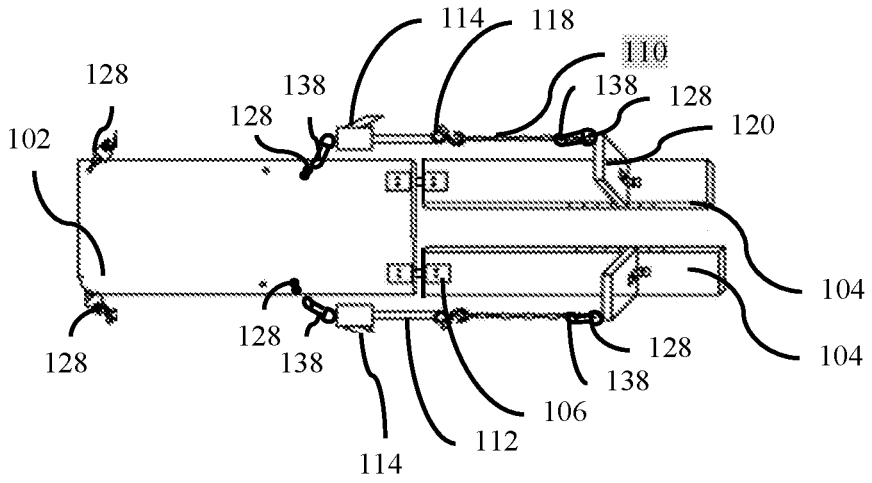
FIG. 2 illustrates a top side perspective view of the portable hamstring stretcher/exerciser device mounted with a foot board for stretching calf and Achilles tendons, according to an embodiment herein.

FIG. 2 illustrates a top side perspective view of the portable hamstring stretcher/exerciser device mounted with a foot board for stretching calf and Achilles tendons, according to an embodiment herein. With respect to FIG. 2, the portable hamstring stretcher is in an open position and is operated by a user by sitting on the primary board 102 and strapping his legs to the secondary boards (leg pieces) 104.

Using the ratchet 114 and the ratchet strap 112, the user is able to exercise the calf and Achilles tendon. A foot-piece 120 is used for bending foot at the ankle and the forefoot.

Figure 3:
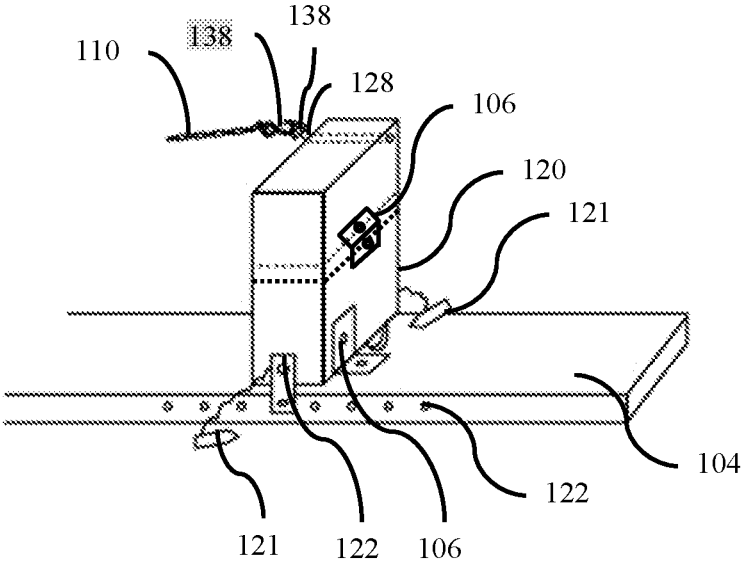
FIG. 3 illustrates a side perspective view of a foot-piece or foot board/foot rest mounted on the portable hamstring stretcher/exerciser device, according to an embodiment herein.
Figure 4:
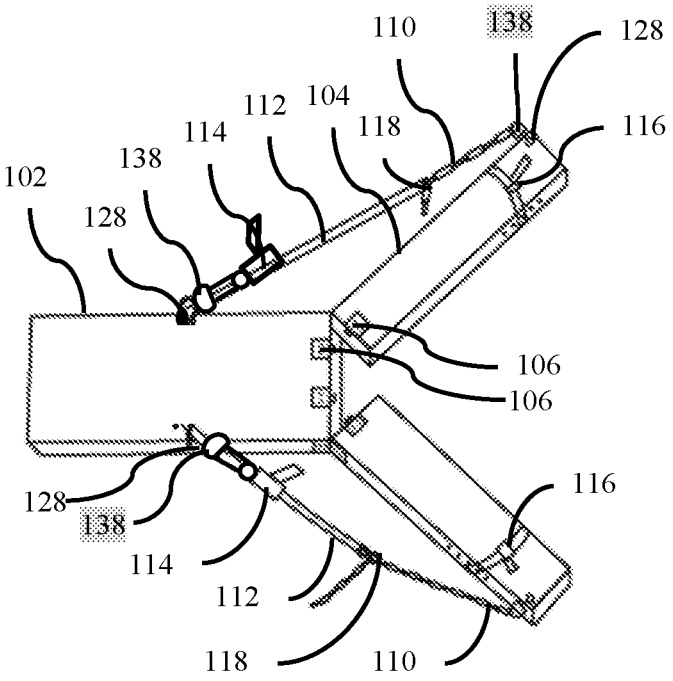
FIG. 4 illustrates a top side perspective view of the portable hamstring stretcher/exerciser device with lower boards stretched horizontally apart from each other, according to an embodiment herein.

FIG. 3 illustrates an enlarged side perspective view of a foot-piece or foot board/foot rest mounted on the portable hamstring stretcher/exerciser device, according to an embodiment herein. With respect to FIG. 3, a plurality of adjustment holes 122 is provided to adjust the length and breadth of the foot-piece 120. The holes are provided to put the foot piece at touching sole of the foot depending on the length of the foot of the users. The taller the user, the foot piece 120 is nearer to the bottom of the secondary board. The foot-piece 120 is adjusted to the secondary board (leg pieces) 104 using a plurality of pins and plates. The foot rest is mounted on the lower board 104 through a plurality of adjustable pins 121 with 1"×1.5" plate. A plurality of holes are provide at the side edges of the lower board 104 to fix the foot rest at any desired position based on the length of the leg. The footrest is mounted at any desired position by inserting the adjustable pins in a corresponding hole. The foot rest is provided with two portions/pieces that are coupled through a hinge 106 to fold the upper portion over the lower portion/piece of the foot rest. The upper portion/piece of the foot rest is folded over to follow the toe portion of the user foot, and the lower portion of the footrest is folded over to bend the ankle FIG. 4 illustrates a top side perspective view of the portable hamstring stretcher/exerciser device with lower boards stretched horizontally apart from each other, according to an embodiment herein. With respect to FIG. 4, the portable hamstring stretcher device provides an option to move the legs both vertically and horizontally. The vertical movement of the secondary board (leg pieces) 104 helps the user to exercise the hamstring muscles. The horizontal movement of the secondary board (leg pieces) 104 helps the user to exercise the inner thigh muscles. The portable hamstring stretcher is converted to move either horizontally or vertically by changing the plurality of hinges 106. The plurality of hinges 106 is inserted horizontally to the primary board 102 and the secondary board 104 to operate the portable hamstring stretcher vertically to convert to the inner thigh application. The plurality of hinges 106 is inserted vertically to the primary board 102 and the secondary board 104 to operate the portable hamstring stretcher horizontally. The snappable hooks are released from the D-rings 128 on top of the upper board 102 and the other snappable hooks are attached to the D-ring on the bottom portion of the upper board. The ratchet 114, the ratchet strap 112, the adjustable leg strap 116, the chain 110 are adjusted accordingly to provide a horizontal movement of the portable hamstring stretcher.

Figure 5:
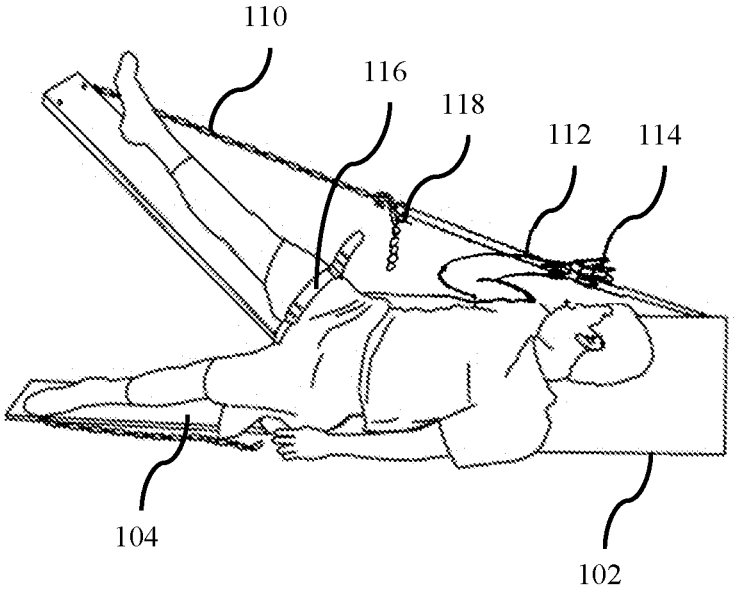
FIG. 5 illustrates a top side perspective view of the potable hamstring stretcher/exerciser device used for lifting one leg vertically for stretching hamstring, according to an embodiment herein.
Figure 6:
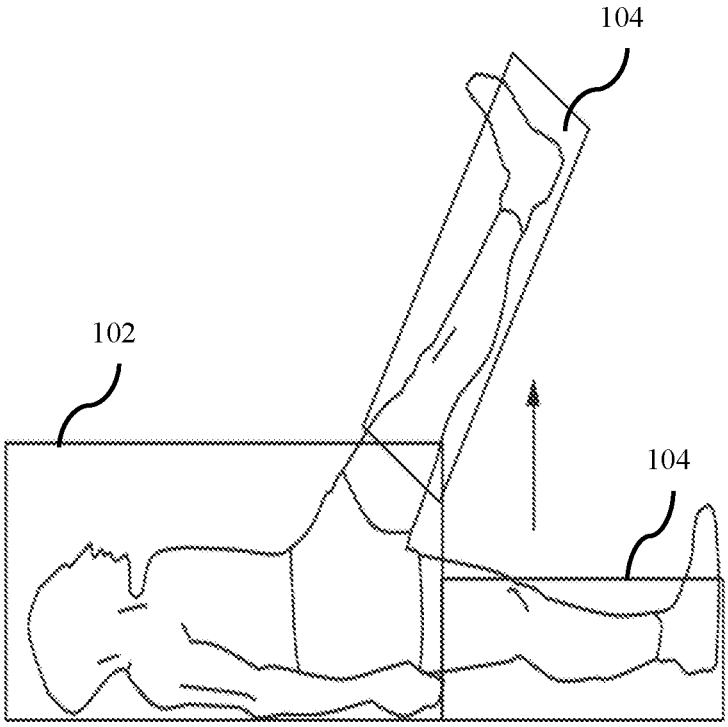
FIG. 6 illustrates a side view of the portable hamstring stretcher/exerciser device used for lifting one leg vertically for stretching hamstring, according to an embodiment herein.

FIG. 5 illustrates a top side perspective view of the potable hamstring stretcher/exerciser device used for lifting one leg vertically for stretching hamstring, according to an embodiment herein, while FIG. 6 illustrates a side view of the portable hamstring stretcher/exerciser device used for lifting one leg vertically for stretching hamstring, according to an embodiment herein. With respect to FIG. 5 and FIG. 6, the user has adjusted the components of the portable hamstring stretcher to exercise the hamstring muscles effectively. The user lays on the primary board 102, and has tied the legs to the secondary board (leg pieces) 104 using the adjustable leg straps 116. Further, using the ratchet 114, the ratchet strap 112, the chain 110, and the hooks 118 and 138, the desired amount of hamstring is stretched.

Figure 7:
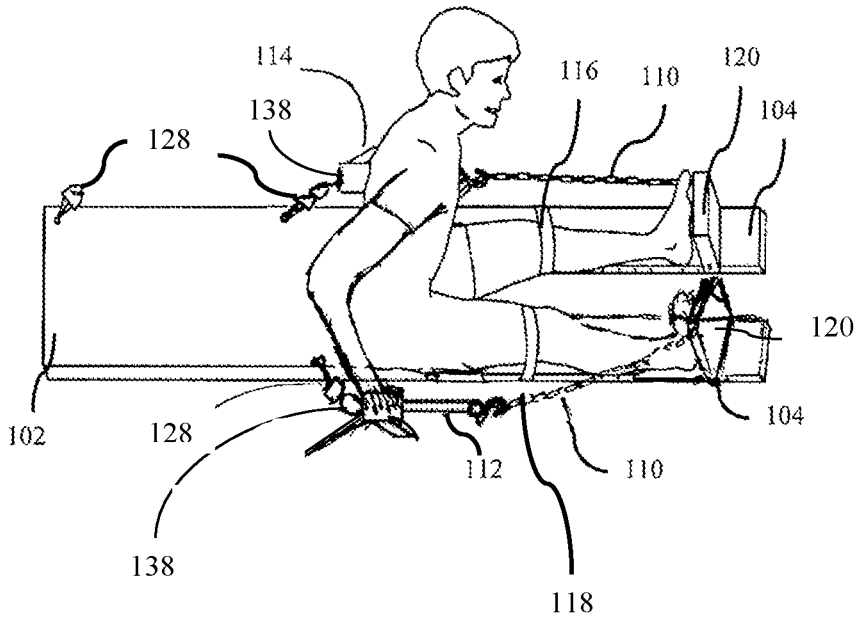
FIG. 7 illustrates a side perspective view of the portable hamstring stretcher/exerciser device used for stretching calf and Achilles tendons, according to an embodiment herein.

FIG. 7 illustrates a side perspective view of the portable hamstring stretcher/exerciser device used for stretching for stretching calf and Achilles tendons, according to an embodiment herein. With respect to FIG. 7, a foot-piece 120 is used for bending foot. The foot piece is constructed using a bendable material such as flexible metal, plastic, wood, cardboard and the like. According to an embodiment herein, the foot-piece 120 is an essential part of the portable hamstring stretcher. According to an embodiment herein, the foot-piece 120 is an optional part of the portable hamstring stretcher. A plurality of adjustment holes 122 is provided to adjust the length and breadth of the foot-piece 120. The foot-piece 120 is adjusted to the secondary board (leg pieces) 104 using a plurality of holes 122, pins and plates 121.

The user has adjusted the components of the portable hamstring stretcher to exercise the hamstring muscles effectively. The user sits on the primary board 102, and has tied the legs to the secondary board (leg pieces) 104 using the adjustable leg straps 116. Further, using the ratchet 114, the ratchet strap 112, the chain 110, the hooks 118 and 138, and the foot board, the calf muscles and tendons are stretched.

Figure 8:
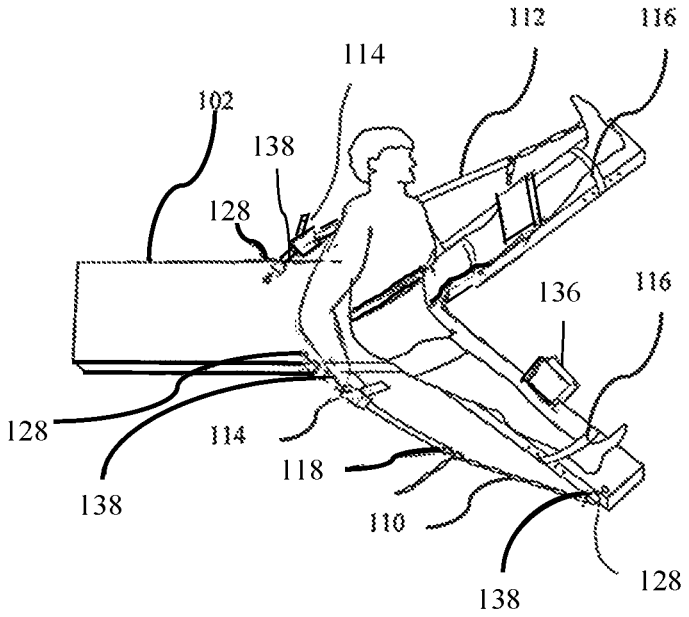
FIG. 8 illustrates a perspective view of the portable hamstring stretcher/exerciser device used for stretching inner thighs, according to an embodiment herein.

FIG. 8 illustrates a perspective view of the portable hamstring stretcher/exerciser device used for stretching inner thighs, according to an embodiment herein. The portable hamstring stretcher device provides an option to move the legs both vertically and horizontally. The vertical movement of the secondary board (leg pieces) 104 helps the user to exercise the hamstring muscles. The horizontal movement of the secondary board (leg pieces) 104 helps the user to exercise the inner thigh muscles. The portable hamstring stretcher is converted to move either horizontally or vertically by changing the plurality of hinges 106. The plurality of hinges 106 is inserted horizontally to the primary board 102 and the secondary board 104 to operate the portable hamstring stretcher vertically. The plurality of hinges 106 is inserted vertically to the primary board 102 and the secondary board 104 to operate the portable hamstring stretcher horizontally. The ratchet 114, the ratchet strap 112, the adjustable leg strap 116, the chain 110 are adjusted accordingly to provide a horizontal movement of the portable hamstring stretcher.

Figure 9:
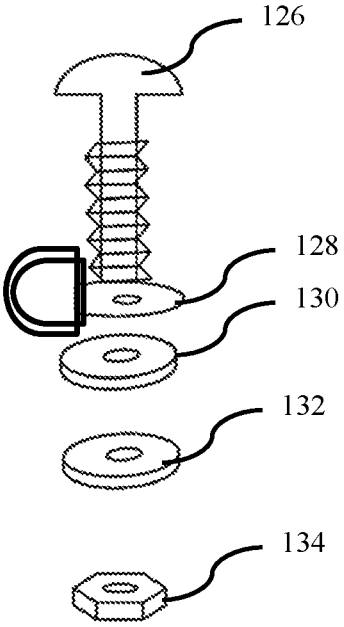
FIG. 9 illustrates an exploded assembly view of a bolt assembly with a D-ring in the portable hamstring stretcher/exerciser device, according to an embodiment herein.

FIG. 9 illustrates an exploded assembly view of a bolt assembly with a D-ring in the portable hamstring stretcher/exerciser device, according to an embodiment herein. The bolt assembly comprises the screw 126, the D-ring 128, the washer 130, the washer 132 and the nut 134. The D-ring 128 is used for fastening the ratchet straps 112 to the primary board 104 using snappable hook attached to the ratchet strap 112. The screw 126 is inserted into the holes provided in the primary board 104 for securing the D-ring 128 to the primary board 104. The screw 126 is inserted into the primary board 104 through the upper washer 130 and the D-ring 128. The screw is then tightened to the primary board 104 using the nut 134 and the washer 132. According to an embodiment herein, the screw 126 gets tightened with the washer 132 and D-ring 128 without the ratchet 114 attached to it, and the ratchet 114 and the fixed end of the ratchet strap 112 gets attached and removed with a snappable hook attached to it, depending on which application is used.

Figure 10:
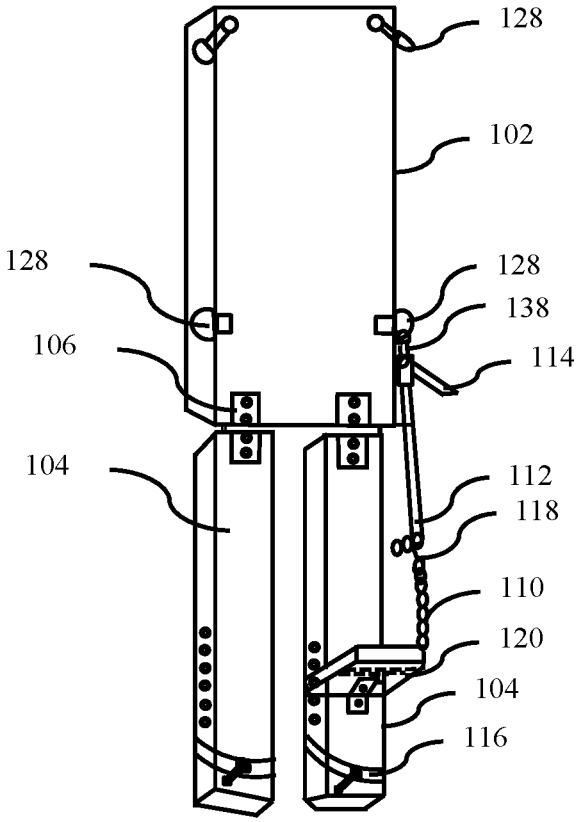
FIG. 10 illustrates a top side perspective view of the portable hamstring stretcher/exerciser device mounted with a foldable footboard/foot rest for stretching calf and Achilles tendons, according to an embodiment herein.

FIG. 10 illustrates a top side perspective view of the portable hamstring stretcher/exerciser device mounted with a footboard for stretching calf and Achilles tendons, according to an embodiment herein. With respect to FIG. 10, the portable hamstring stretcher is operated by a user by sitting on the primary/upper board 102 and strapping his legs to the secondary/lower boards (leg pieces) 104. Using the ratchet 114 and the ratchet strap 112, the user is able to exercise the calf muscles and the Achilles tendons. A foot-piece 120 is used for bending foot. According to an embodiment herein, the foot-piece 120 is an optional part of the portable hamstring stretcher/exerciser. According to an embodiment herein, the ratchet 114 is attached to the D-ring 128 at the lower portion of the primary board 102 and "S" hook to chain 110 attached to the outer edge of the foot-piece 120. According to an embodiment herein, the pin and plates 121 are for ankle folding and upper hinges are for toe folding. The heel of the user touches the bottom of the foot piece. The foot-piece 120 leans on sole of the foot. The foot piece is provided with two portions that are coupled through the hinges so that an upper portion of the foot rest is foldable over the lower face to follow the sole of the foot and to enable the user to bend the toe portion of the foot rest.

According to an embodiment herein, the foot-piece is adjustable using a plurality of hinges 106.

Figure 11:
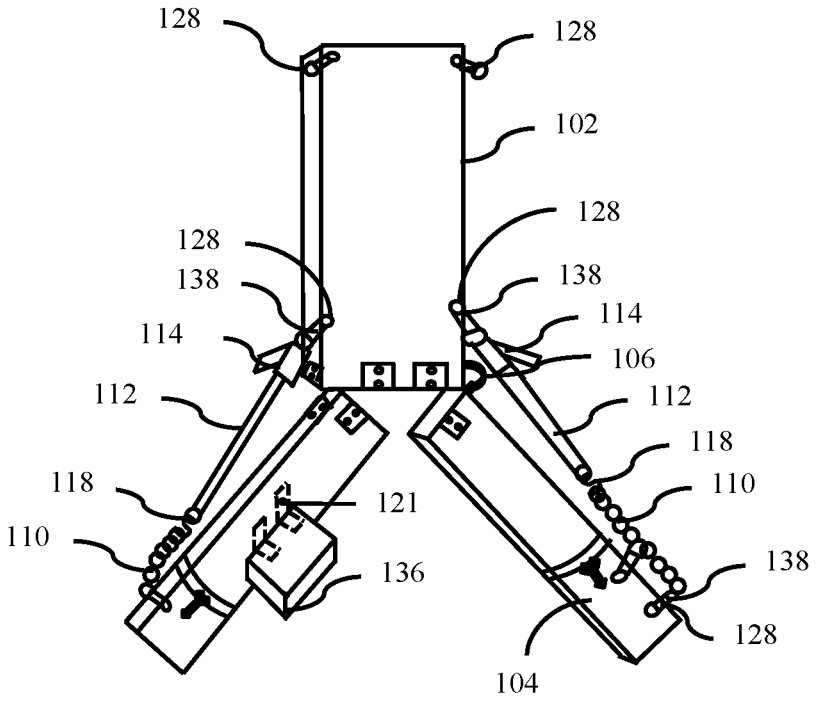
FIG. 11 illustrates a top side perspective view of the portable hamstring stretcher/exerciser device with lower boards stretched horizontally apart from each other, according to an embodiment herein.

FIG. 11 illustrates a top side perspective view of the portable hamstring stretcher/exerciser device with lower boards stretched horizontally apart from each other, according to an embodiment herein. The horizontal movement of the secondary/lower board (leg pieces) 104 helps the user to exercise the inner thigh muscles. The portable hamstring stretcher is configured to move horizontally by changing the plurality of hinges 106. The plurality of hinges 106 is inserted horizontally to the primary board 102 and the secondary board 104 to operate the portable hamstring stretcher vertically. The plurality of hinges 106 is inserted vertically to the primary board 102 and the secondary board 104 to operate the portable hamstring stretcher horizontally. The ratchet 114, the ratchet strap 112, the adjustable leg strap 116, and the chain 110 are adjusted accordingly to provide a horizontal movement of the portable hamstring stretcher. Further, the portable hamstring stretcher/exerciser includes the slide-stopper 136. The slide-stopper 136 is configured for preventing the legs from sliding while stretching inner thigh muscles. According to an embodiment herein, the slide-stopper 136 is an essential part of the portable hamstring stretcher/exerciser. According to an embodiment herein, the slide-stopper 136 is an optional part of the portable hamstring stretcher/exerciser. The slide-stopper 136 is adjusted with respect to the secondary boards (leg pieces) 104 using a plurality of holes and pins to prevent the thighs from sliding off the board. The location of the slide-stopper 136 is adjusted using removable pins 121.

Figure 12:
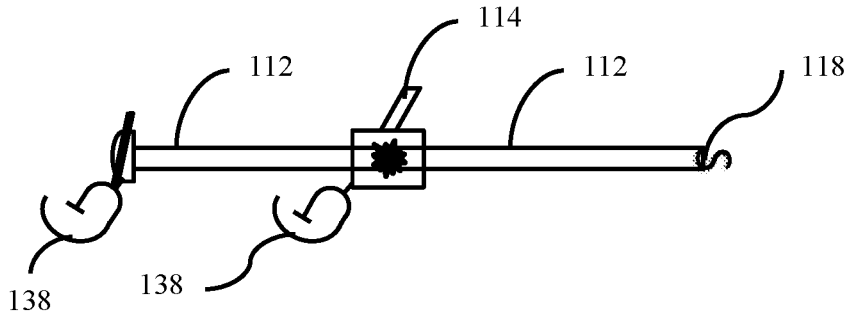
FIG. 12 illustrates a ratchet used in the portable hamstring stretcher/exerciser device, according to an embodiment herein.

FIG. 12 illustrates a ratchet used in the portable hamstring stretcher/exerciser device, according to an embodiment herein. The ratchet set is composed of two parts, a fixed end and an adjustable end. The fixed end remains constant and is between 12"-18", and the adjustable end shortens by applying the ratchet. The fixed end has a snappable hook, and the adjustable end has "S" shaped hook that grabs the chain. According to an embodiment of the present invention, the snappable hook can be removed and attached to the rings on two locations of the upper board.

Figure 13:
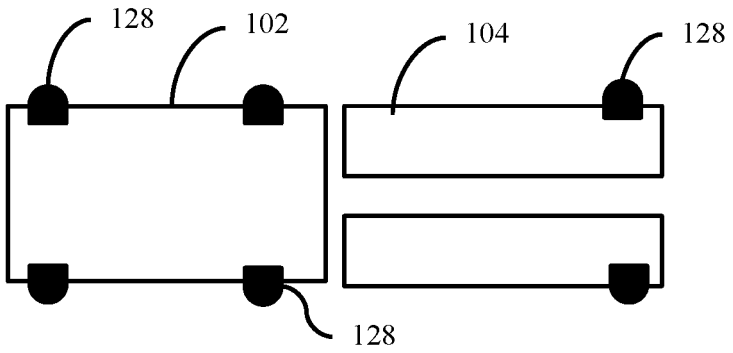
FIG. 13 illustrates the position of the D-rings in the portable hamstring stretcher/exerciser device, according to an embodiment herein.

FIG. 13 illustrates the position of the D-rings in the portable hamstring stretcher/exerciser device, according to an embodiment herein. The D-rings 128 are located on two locations on the upper board 102, and at one location at the lower board 104. According to an embodiment herein, the other D-rings is on the foot piece outer edge on left leg board and the right leg board. According to an embodiment herein, the D-rings are located at two locations on the upper board 102 and bottom of the lower board 104. For example, the D-rings are located within a range of 12 inches to 18 inches from the bottom of the upper piece 102.

According to an embodiment herein, the distance between the ratchet and the fixed end is only a snappable hook that is attached to the ratchet during application of inner thing stretching and calf and tendons stretching. According to an embodiment herein, both locations are for easy access to the ratchet during the application. Further, the D-rings 128 are placed at half an inch from the edge of the upper board 102 and the lower board 104 and foot piece 120.

Figure 14:
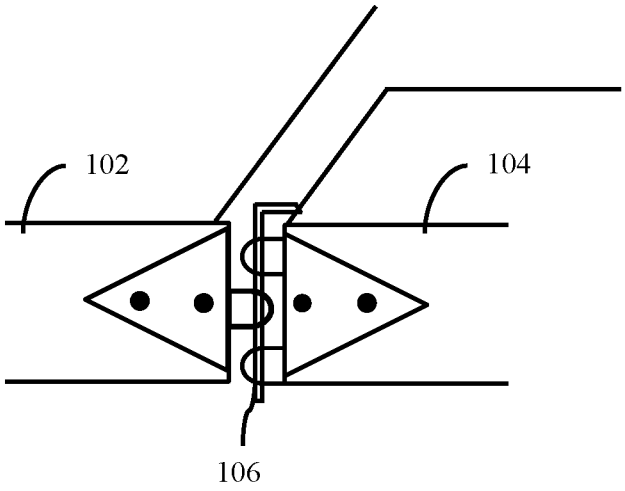
FIG. 14 illustrates the side view of the hinges of the portable hamstring stretcher/exerciser device, according to an embodiment herein.

FIG. 14 illustrates the side view of the hinges used for portable hamstring stretcher/exerciser, according to an embodiment herein. According to an embodiment herein, when the user has to switch from the hamstring function to inner thigh stretch function, the snappable hook from the top of the upper board 102 has to be removed and is reconnected to the lower D-ring at the bottom of the upper board 102. The removable pins are removed from the top hinges 106, the upper board 102 and the lower board 104 is separated, realigned and vertical pins are inserted on the sides of the upper board 102 and the lower board 104, while the chains remain on the lower board 104.

According to an embodiment herein, the hamstring muscle, the inner thigh muscles and the Achilles tendons are gradually stretched without applying any other muscle of the body. Further, the portable hamstring stretcher device does not use any electric power to stretch the muscles.

According to an embodiment herein, the muscles are stretched without any effort by the user, and the stretching is allowed for long periods without any side effects or harmful effects. The portable hamstring stretcher device allows the user to engage in activities such as reading, watching television, texting, and the like as the portable hamstring device does not involve active participation of hands.

According to an embodiment herein, the chain is used for attaching the ratchet strap hook to the chain depending on the flexibility of the user. The chain has a plurality of spots (more than 30) that is hooked to the ratchet strap through "S" hook. According to an embodiment herein, additional gradual stretching is done by applying the ratchet slowly, which pulls the pieces closer stretching the muscles.

According to an embodiment herein, the portable hamstring stretcher facilitates and prolongs a stretching of the hamstring muscles by eliminating the need to exert a force by hand. The ratchet is used instead, to allow the sturdy and prolong a force to stretch the hamstring muscles.

According to an embodiment herein, the equipment finds usage in gym, hospitals, physical therapies, home, and outdoor sport fields and the like.

According to an embodiment herein, the equipment is equally effective for use by both the professionals and hobbyists/unskilled persons. According to an embodiment herein, the equipment is folded and fit easily under a bed. According to an embodiment herein, the equipment is a light weight device, and allows the user to engage in multiple operations/functions without any complication.

According to an embodiment herein, the portable hamstring stretcher does not require any electrical application, thereby making the device safe and free from electrical hazards.

According to an embodiment herein, the portable hamstring muscles exerciser device does not require a strict maintenance and does not have many parts.

According to an embodiment herein, the chain is used to attach to the ratchet hook at a point that stretches the leg to a maximum limit with a minimal force depending on the flexibility of the user. According to an embodiment herein, the ratchet shortens the length between the primary board and the secondary board (leg pieces) that are operated with a very gradual force applied by the user as the tension is tolerable by the user.

According to an embodiment herein, the portable hamstring stretcher device is operated without use of any electrical parts.

According to an embodiment herein, the portable hamstring stretcher device is a light-weight device and easily assembled.

According to an embodiment herein, the portable hamstring stretcher device is used effectively by professionals and hobbyists.

According to an embodiment herein, portable hamstring stretcher device is used to exercise the hamstring without straining other muscles of the body.

According to an embodiment herein, the portable hamstring stretcher device is constructed economically.

According to an embodiment herein, the portable hamstring stretcher device allows the user to stretch the hamstring muscles for a longer duration without causing any injury.

According to an embodiment herein, the portable hamstring stretcher device allows the user to stretch inner thigh muscles.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A portable hamstring stretcher/exerciser device for stretching hamstring muscles, inner thigh muscles, calf muscles and Achilles tendon stretching, the portable hamstring stretcher/exerciser device comprising:

an upper board configured for allowing a user to rest an upper part of the user's body;

two lower boards for supporting legs of the user, wherein the two lower boards include a left lower board for supporting a left leg of the user and a right lower board for supporting a right leg of the user, and wherein the left lower board and the right lower board are configured to move vertically and horizontally;

a foot rest mounted on each of the lower boards through a plurality of hinges, and wherein the foot rest is mounted on both the left lower board and the right lower board;

a plurality of hinges for coupling the upper board with the left lower board and right lower board, and wherein the left lower board and the right lower board are configured to fold over the upper board;

a chain attached to each of the left lower board and the right lower board, and wherein each chain is attached to a side edge of the left lower board and the right lower board or to the foot rest mounted on the left lower board and the right lower board;

a plurality of ratchets attached to the upper board for linking with the chain of the left lower board and the chain of the right lower board, and wherein the plurality of ratchets are mounted next to a hand position of the user;

a plurality of ratchet straps attached respectively to the plurality of ratchets attached to the upper board for holding the left lower board and the right lower board at any desired angle;

a plurality of hooks attached respectively to the plurality of ratchet straps for coupling with the chain of the left lower board and the chain of the right lower board at any desired point on either chains;

a plurality of adjustable leg straps attached to the lower boards for providing grip to the legs of the user, and wherein the plurality of adjustable leg straps are attached to the left lower board and the right lower board;

a plurality of bolt assemblies mounted on the upper board, the left lower board and the right lower board respectively for attaching the ratchet straps and chains;

wherein each ratchet is configured to pull the chain of the left lower board or the chain of the right lower board, and wherein the chains are configured to be pulled to move the right lower board and left lower board vertically to shorten a length of a hamstring muscle of the user, and wherein the chains are configured to be pulled to move the right lower board and left lower board horizontally to stretch an inner thigh muscle of the user, and wherein the chains are configured to be pulled to move the foot rest mounted on the right lower board and left lower board to stretch a calf muscle or Achilles tendon of the user.

2. The portable hamstring stretcher/exerciser device according to claim 1, wherein the foot rest is removably mounted on both the left lower board and right lower board, wherein the foot rest is removably mounted on the left lower board or the right lower board, and wherein the foot rest is removably mounted at any desired position on the left lower board or the right lower board by inserting an adjustable pin through a respective hole in a plurality of holes arranged at the side edges of the right lower board and left lower board.

3. The portable hamstring stretcher/exerciser device according to claim 1, wherein the left lower board and the right lower board are moved vertically and horizontally by selectively folding the left lower board and/or the right lower board over the upper board vertically or horizontally by adjusting the plurality of hinges.

4. The portable hamstring stretcher/exerciser device according to claim 1, further comprising a plurality of holes provided respectively on the upper board, the left lower board, the right lower board, and the foot rest for receiving the plurality of bolt assemblies for securing the plurality of ratchet straps and the chains, and wherein the plurality of holes comprises a first set of holes, a second set of holes, and a third set of holes, and wherein the first set of holes are provided on the upper board for receiving a first bolt assembly for securing the plurality of ratchets to the upper board, and wherein the second set of holes are provided on the left lower board and the right lower board for receiving a second bolt assembly for security the chain respectively with the left lower board and the right lower board, and wherein the third set holes are provided on the foot rest mounted on the left lower board and/or the right lower board for receiving a third bolt assembly for securing the chain to the foot rest mounted on the left lower board and/or the right lower board.

5. The portable hamstring stretcher/exerciser device according to claim 4, further comprising a fourth set of holes, wherein the fourth set of holes are provided from a pre-defined distance from both sides of a bottom of the upper board to install bolt assemblies and D-rings to receive snappable hooks.

6. The portable hamstring stretcher/exerciser device according to claim 1, wherein each bolt assembly comprises a screw, a plurality of washers, D-ring and a bolt.

7. The portable hamstring stretcher/exerciser device according to claim 1, wherein the foot rest is configured or designed to comply with a profile of a sole of the user's foot.

8. The portable hamstring stretcher/exerciser device according to claim 1, wherein the plurality of hooks are each arranged in an "S" shape and snappable.

9. The portable hamstring stretcher/exerciser device according to claim 1, wherein the adjustable leg straps are configured to prevent a bending of knees of the user.

10. The portable hamstring stretcher/exerciser device according to claim 1 wherein the upper board is covered using a soft material.

11. The portable hamstring stretcher/exerciser device according to claim 1, wherein the upper board is integrally formed with the soft material, and wherein a soft material is selected from a group consisting of a gym mat, cotton cloth, rubber sheet, and plastic sheet.

12. The portable hamstring stretcher/exerciser device according to claim 1, wherein the lower boards are covered using a soft material.

13. The portable hamstring stretcher/exerciser device according to claim 1, wherein the lower boards are integrally formed with a soft material, and wherein the soft material is selected from a group consisting of a gym mat, cotton cloth, rubber sheet, and plastic sheet.

14. The portable hamstring stretcher/exerciser device according to claim 1, wherein the upper board is integrally formed with a hard material, and wherein the hard material is selected from a group consisting of a sheet metal, plywood, and plastic.

15. The portable hamstring stretcher/exerciser device according to claim 1, wherein the lower boards are integrally formed with a hard material, and wherein the hard material is selected from a group consisting of a sheet metal, plastic, and plywood.

16. The portable hamstring stretcher/exerciser device according to claim 1, wherein the foot rest is formed with two pieces, and wherein the two pieces are an upper piece and a lower piece and wherein the upper piece and lower pieces are coupled through a hinge to fold the upper piece over the lower piece to follow a sole of the user's foot, and wherein the upper piece of the foot rest is folded over the lower piece to support the toe portion of the user's foot.

17. The portable hamstring stretcher/exerciser device according to claim 1, further comprising a slide stopper board mounted on the left lower board and right lower board to hold a left leg and a right leg in position during hamstring stretching operation or inner thigh stretching operation.

18. The portable hamstring stretcher/exerciser device according to claim 1, wherein the ratchet straps are mounted to an upper edge or bottom edge of the upper board.

* * * * *